US005500153A

United States Patent [19]

Figueroa et al.

[11] Patent Number: 5,500,153

[45] Date of Patent: Mar. 19, 1996

[54] HANDWASH LAUNDRY DETERGENT COMPOSITION HAVING IMPROVED MILDNESS AND CLEANING PERFORMANCE

[75] Inventors: Francisco R. Figueroa, Montalban-Caracas; Roberto M. Jarrin, Caracas, both of Venezuela

[73] Assignee: The Procter & Gamble Company, Cincinnati, Ohio

[21] Appl. No.: 270,709

[22] Filed: Jul. 5, 1994

[51] Int. Cl.[6] ..... C11D 1/29; C11D 1/83; C11D 1/90; C11D 3/37

[52] U.S. Cl. ..... 252/548; 252/174; 252/174.23; 252/547; 252/550; 252/551; 252/546; 252/174.21

[58] Field of Search ..... 252/174, 174.23, 252/547, 548, 550, 551, 546, 174.21

[56] References Cited

U.S. PATENT DOCUMENTS

| | | | |
|---|---|---|---|
| 2,703,798 | 3/1955 | Schwartz | 260/211 |
| 2,965,576 | 12/1960 | Wilson | 252/137 |
| 2,982,737 | 5/1961 | Boettner et al. | 252/152 |
| 2,993,887 | 7/1961 | Zech | 260/211 |
| 3,312,627 | 4/1967 | Hooker | 252/152 |
| 3,654,166 | 4/1972 | Gukert et al. | 252/117 |
| 4,470,923 | 9/1984 | Kuster | 252/547 |
| 5,238,609 | 8/1993 | Smith et al. | 252/547 |
| 5,244,593 | 9/1993 | Ruselle et al. | 252/99 |
| 5,254,281 | 10/1993 | Pichardo et al. | 252/108 |
| 5,318,228 | 6/1994 | Surutzidis | 252/548 |
| 5,332,528 | 7/1994 | Pan et al. | 252/548 |
| 5,338,491 | 8/1994 | Connor et al. | 252/548 |
| 5,376,310 | 12/1994 | Eripe et al. | 252/548 |
| 5,378,388 | 1/1995 | Pancheri | 252/174.25 |
| 5,378,409 | 1/1995 | Ofusu-Asante | 252/548 |
| 5,387,373 | 2/1995 | Naik | 252/546 |

FOREIGN PATENT DOCUMENTS

| | | | |
|---|---|---|---|
| WO92/06162 | 4/1992 | Australia | C11D 3/00 |
| WO92/06157 | 4/1992 | Australia | C11D 1/65 |
| WO92/06160 | 4/1992 | Australia | C11D 1/835 |
| 199403 | 10/1986 | European Pat. Off. . | |
| 0285768 | 10/1988 | European Pat. Off. | C11D 3/32 |
| 2020597 | 1/1987 | Japan . | |
| 2020596 | 1/1987 | Japan . | |
| 3017999 | 1/1988 | Japan . | |
| 1104491 | 2/1968 | United Kingdom . | |
| 1421967 | 1/1976 | United Kingdom . | |
| 2272223 | 5/1994 | United Kingdom . | |

*Primary Examiner*—Paul Lieberman
*Assistant Examiner*—Michael P. Tierney
*Attorney, Agent, or Firm*—Ken K. Patel; Jacobus C. Rasser; Jerry J. Yetter

[57] ABSTRACT

The invention is directed to a handwashing laundry detergent composition containing a surfactant system including selected levels of an anionic surfactant and a nonionic surfactant mixture of polyhydroxy fatty acid amide surfactant and an amine oxide surfactant in a selected weight ratio. By judiciously selecting the surfactant system components and their respective levels and proportions as contained herein, the detergent composition surprisingly exhibits superior cleaning, sudsing and mildness during conventional hand washing operations. The inclusion of other adjunct detergent ingredients such as builders and other optional components enhance the unexpected superior cleaning, sudsing and mildness results achieved by the handwashing detergent product.

6 Claims, No Drawings

HANDWASH LAUNDRY DETERGENT COMPOSITION HAVING IMPROVED MILDNESS AND CLEANING PERFORMANCE

FIELD OF THE INVENTION

The present invention is directed to a high-sudsing, mild, hand laundry detergent composition. The laundry detergent composition contains a surfactant system especially selected to minimize harshness usually imparted to the users hands during typical hand laundering operations.

BACKGROUND OF THE INVENTION

As is known, detergent compositions in the form of synthetic detergent granules and liquids are used in may areas throughout the world for purposes of laundering soiled clothes. In areas in which mechanical washing machines are not prevalent, laundering soiled clothes generally entails some sort of handwashing operation. Such geographic areas use detergent compositions in granular, paste, gel, or bar form. In operations involving hand laundering, the hands and arms of the user are typically exposed to the aqueous laundering solutions in which the detergent composition is contained. Repeated exposure to laundering solutions during handwashing operations can lead to skin irritation which can eventually lead to skin lesions or other skin damage. Many attempts have been made by formulators of handwash laundry detergents to alleviate the detrimental effects of hand laundering operations on the arms and hands of users of such detergent products. It would therefore be desirable to have a laundry detergent composition suitable for handwash operations which exhibits mildness toward the skin of users while maintaining or improving cleaning performance.

Currently, formulators of detergent compositions used for hand laundering operations generally incorporate high levels of linear alkylbenzene sulfonate and alkyl sulfate surfactants since they are very effective in both cold and hot water wash conditions. The linear alkylbenzene sulfonate surfactants have also been utilized frequently for their ability to provide excellent cleaning of grease and oil stains. Combinations of linear alkylbenzene sulfonate surfactants and alkyl sulfate surfactants are desirable because they combine the excellent grease and oil cleaning of linear alkylbenzene sulfonate (along with good cleaning across a broad range of stain types) with the excellent particulate soil removal performance of alkyl sulfate surfactants. Whereas alkyl sulfate surfactants are readily derived from renewable resources, it would be desirable to provide a handwashing detergent that could provide comparable or improved cleaning performance wherein the linear alkylbenzene sulfonate surfactants was either partially or completely replaced with surfactant that could easily be made from natural, renewable, non-petroleum raw materials.

Additionally, during conventional hand laundering operations, detergent ingredients are oftentimes depleted from the laundering solutions. This depletion is evidenced by a reduction in cleaning efficacy of the laundering solution and a corresponding reduction in lather volume. Consequently, the lathering or sudsing of the laundering solution is commonly used by consumers as an indicator of cleaning efficacy. For such reasons, it is desirable for laundry detergents especially suitable for handwashing operations to have a high degree of sudsing or lathering.

Accordingly, it would be desirable to have a laundry detergent composition suitable for handwashing operations that exhibits improved cleaning performance and mildness characteristics to the hands and arms of users. It would also be desirable to have such a detergent composition which includes substantially renewable or more biodegradable components while also exhibiting improved cleaning performance. Also, it would be desirable for such a detergent composition to maintain excellent sudsing or lathering features.

BACKGROUND ART

The following references disclose polyhydroxy fatty acid amide surfactants in various forms: U.S. Pat. Nos. 2,703,798; 2,965,576; 2,993,887; and European Patent 285,768. The following reference disclose laundry detergent or toilet bars including various surfactants: U.S. Pat. Nos. 2,982,737; 3,312,627; and 5,254,281.

SUMMARY OF THE INVENTION

The instant invention is directed to a handwashing laundry detergent composition containing a surfactant system including selected levels of anionic surfactant and a nonionic surfactant mixture of polyhydroxy fatty acid amide surfactant and an amine oxide surfactant in a selected weight ratio. By judiciously selecting the surfactant system components and their respective levels and proportions as defined herein, the detergent composition surprisingly exhibits superior cleaning, sudsing and mildness during conventional handwashing operations. The inclusion of adjunct detergent ingredients such as builders and other optional components enhance the unexpected superior cleaning, sudsing and mildness results achieved by the present handwashing detergent product. All percentages, ratios and proportions used herein are by weight, unless otherwise specified. All documents including patents and publications cited herein are incorporated herein by reference.

In accordance with one aspect of the invention, a laundry detergent composition for use in handwash operations is provided. The laundry detergent composition comprises: (a) from about 5% to about 50% by weight of a surfactant system including, by weight of the surfactant system, (i) from about 50% to about 75% of an anionic surfactant selected from the group consisting of alkyl sulfates, alkyl ethoxy sulfates and mixtures thereof; and (ii) from about 10% to about 40% of a nonionic surfactant mixture containing a polyhydroxy fatty acid amide surfactant and an amine oxide surfactant, wherein the weight ratio of the polyhydroxy fatty acid amide to amine oxide is from about 1:5 to about 5:1; (b) from about 1% to about 50% of a detergency builder; and (c) the balance comprising adjunct detergent ingredients. The adjunct detergent ingredients may be selected from the group consisting of bleaching agents, bleach activators, enzymes, polymeric anti-redisposition agents, polymeric dispersants, polymeric soil release agents, chelants, perfumes, dye transfer inhibitors and mixtures thereof.

In a preferred embodiment of the invention, the laundry detergent composition further includes from about 5% to about 10% by weight of the surfactant system of cocoamidopropyl betaine surfactant. Another preferred embodiment entails including in the composition from about 1% to about 20% by weight of the surfactant system of a $C_{9-18}$alkyl ethoxylate surfactant having an ethoxylation level of from about 3 to about 12. Yet another embodiment envisions incorporating into the composition a zwitterionic surfactant having a $C_{9-18}$alkyl chain length. The composition may also include from about 1% to about 7% of a sodium polyacrylate for anti-redeposition purposes.

Optionally, the detergent composition may further include surfactants selected from the group consisting of alkyl benzene sulfonates, alkyl ethoxylates, alkyl phenol alkoxylates, alkylpoly glucosides, secondary alkyl sulfates and mixtures thereof. The use, however, of alkylbenzene sulfonates is preferably kept at a minimum, if used at all in the instant composition. Other preferred embodiments include having the laundry detergent composition as described herein in liquid form, granular form or in the form of a laundry bar. Another embodiment of the invention is directed to a method of laundering soiled clothes comprising the step of contacting the clothes by way of a users hands with an effective amount of a laundry detergent composition according to the invention in an aqueous solution. An "effective amount" in typical handwashing operations is between about 2000 ppm to about 8000 ppm in an aqueous laundering solution (14 gpg hardness, 25° C.) and the time for such handwashing operations is about 10 minutes.

A highly preferred embodiment of the invention contemplates a laundry detergent composition for use in handwash operations comprising: (a) from about 5% to about 50% by weight of a surfactant system including, by weight of the surfactant system, (i) from about 50% to about 75% of an anionic surfactant selected from the group consisting of alkyl sulfates, alkyl ethoxy sulfates and mixtures thereof; (ii) from about 10% to about 40% of a nonionic surfactant mixture containing a polyhydroxy fatty acid amide surfactant and an amine oxide surfactant, wherein the weight ratio of the polyhydroxy fatty acid amide to amine oxide is from about 1:5 to about 5:1; (iii) from about 5% to about 10% of a zwitterionic surfactant having a $C_{9-18}$alkyl chain length; (b) from about 1% to about 50% of a detergency builder; (c) from about 1% to about 7% of a polymeric anti-redeposition agent; and (d) the balance comprising adjunct detergent ingredients selected from the group consisting of bleaching agents, bleach activators, enzymes, polymeric anti-redeposition agents, polymeric dispersants, polymeric soil release agents, chelants, perfumes, dye transfer inhibitors and mixtures thereof.

Accordingly, it is an object of the invention to provide a laundry detergent composition suitable for handwashing operations that exhibits improved cleaning performance along with improved mildness and sudsing characteristics for the user. It is also an object of the invention to have such a detergent composition which includes substantially renewable or more biodegradable components and yet, maintains the improved cleaning performance. These and other objects, features and attendant advantages of the present invention will become apparent to those skilled in the art from a reading of the following detailed description of the preferred embodiment and the appended claims.

DETAILED DESCRIPTION OF THE PREFERRED EMBODIMENT

In its broadest aspect, the invention contemplates a handwash laundry detergent composition containing: (1) a surfactant system including selected levels of an anionic surfactant and a nonionic surfactant mixture of polyhydroxy fatty acid amide surfactant and an amine oxide surfactant in a selected weight ratio; and (2) a specified level of a detergent builder. Other adjunct detergent materials may optionally be included so as to provide a fully formulated handwash detergent product.

SURFACTANT SYSTEM

The surfactant system of the detergent composition is present in an amount from about 15% to about 40% and, preferably from about 20% to about 25%, by weight. Included in the surfactant system, by weight of the system, is from about 60% to about 75% and, more preferably from about 60% to about 70%, of the an anionic surfactant selected from the group consisting of alkyl sulfates, alkyl ethoxy sulfates and mixtures thereof. The nonionic surfactant mixture as described in detail hereinafter is preferably present in an amount from about 15% to about 40% and, more preferably from about 15% to about 25% by weight of the surfactant system.

The alkyl sulfate surfactant component preferably includes conventional primary alkyl sulfate surfactants have the general formula $$ROSO_3^-M^+$$

wherein R is typically a linear $C_{10}$–$C_{20}$hydrocarbyl group and M is a water-solubilizing cation. Branched-chain primary alkyl sulfate surfactants (i.e., branched-chain "PAS") having 10–20 carbon atoms can also be used herein; see, for example, European Patent Application 439,316, Smith et al, filed 21, Jan. 1991, the disclosure of which is incorporated herein by reference (Included in the term "alkyl" is the alkyl portion of acyl groups). Included in the anionic surfactant component are the $C_{10}$–$C_{18}$alkyl alkoxy sulfates ($AE_xS$"; especially EO 1–7 ethoxy sulfates).

The nonionic surfactant mixture comprises a polyhydroxy fatty acid amide surfactant and an amine oxide surfactant in a ratio from about 1:5 to about 5:1 and more preferably from about 1.5:1 to about 3:1. The polyhydroxy fatty acid amide surfactant preferably has the structural formula:

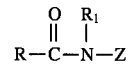

wherein: $R_1$ is H, $C_1$ or $C_4$hydrocarbyl, 2-hydroxy ethyl, 2-hydroxy propyl, or a mixture thereof, preferably $C_{1-4}$alkyl, more preferably $C_1$ or $C_{2_2}$alkyl, most preferably $C_1$alkyl (i.e., methyl); and R is a $C_{5-31}$hydrocarbyl, preferably straight chain $C_{7-19}$alkyl or alkenyl, more preferably straight chain $C_{9-17}$alkyl or alkenyl, most preferably straight chain $C_{11-17}$alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

In Formula (I), $R_1$ can be, for example, N-methyl, N-ethyl, N-propyl, N-isopropyl, N-butyl, N-2-hydroxy ethyl, or N-2-hydroxy propyl.

R—CO—N< can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, by Thomas Hedley & Co., Ltd., U.S. Pat. No. 2,965,576, issued Dec. 20, 1960 to E. R. Wilson, and U.S. Pat. No. 2,703,798, Anthony M. Schwartz, issued Mar. 8, 1955, U.S. Pat. No. 1,985,424, issued Dec. 25, 1934 to Piggott, U.S. Pat. No. 5,188,769, Connor et al, issued Feb. 23, 1993 and U.S. Pat. No. 5,194,639, Connor et al, issued Mar. 16, 1993, each of which is incorporated herein by reference.

The nonionic surfactant mixture also includes an amine oxide surfactant. Nonlimiting examples include $C_{10-18}$ amine oxides, secondary amine oxides such as dimethyl amine oxide, and tertiary amine oxides having the general formula RR'R"NO in which R is a primary alkyl group containing 8 to 24 carbon atoms; R' is methyl, ethyl, or 2-hydroxyethyl; and R" is independently selected from methyl, ethyl, 2-hydroxyethly and primary alkyl groups containing 8 to 24 carbon atoms. Additionally, the tertiary amine oxide surfactant may be in hydrated form and have the general formula RR'R"NO $nH_2O$ wherein R, R' and R" are the same as above and n is 1 or 2. Examples of other tertiary amines suitable for use herein include those containing one or two shortchain groups independently selected from methyl, ethyl, and 2-hydroxyethyl groups, with the remaining valences of the amino nitrogen being satisfied with long-chain groups independently selected from primary alkyl groups containing 8–24 carbons, e.g., octyl, decyl, dodecyl, tetradecyl, hexadecyl, octadecyl, eicosyl, docosyl, and tetracosyl groups. The primary alkyl groups may be branched-chain groups, but the preferred amines are those in which at least most of the primary alkyl groups have a straight chain.

Exemplary of these tert-amines are N-octyldimethylamine, N,N-didecylmethylamine, N-decyl-N-dodecylethylamine, N-dodecyldimethylamine, N-tetradecyldimethylamine, N-tetradecyl-N-ethylmethylamine, N-tetradecyl-N-ethyl-2-hydroxyethylamine, N,N-di-tetradecyl-2hydroxyethylamine, N-hexadecyldimethylamine, N-hexadecyldi-2-hydroxyethylamine N-octadecyldimethylamine, N,N-dieicosylethylamine, N-docosyl-N-2-hydroxyethylmethylamine, N-tetracosyldimethylamine, etc.

Additional amine oxide surfactants and methods of making the same, all of which are suitable for use herein, are disclosed by Borland et al, U.S. Pat. No. 5,071,594 and Tosaka et al, U.S. Pat. No. 5,096,621, incorporated herein by reference.

Optionally, other surfactants may be included in the surfactant system. For example, the composition of this invention can contain betaine detergent surfactants having the general formula:

$$R—\overset{(+)}{N}(R^1)_2—R^2\overset{(-)}{COO}$$

wherein R is a hydrophobic group selected from the group consisting of alkyl groups containing from about 10 to about 22 carbon atoms, preferably from about 12 to about 18 carbon atoms, alkyl aryl and aryl alkyl groups containing a similar number of carbon atoms with a benzene ring being treated as equivalent to about 2 carbon atoms, and similar structures interrupted by amido or ether linkages; each $R^1$ is an alkyl group containing from 1 to about 3 carbon atoms; and $R^2$ is an alkylene group containing from 1 to about 6 carbon atoms.

Examples of preferred betaines are cocoamidopropyl betaine, dodecyl dimethyl betaine, cetyl dimethyl betaine, dodecyl amidopropyl dimethyl betaine, tetradecyldimethyl betaine, tetradecylamidopropyldimethyl betaine, and dodecyldimethylammonium hexanoate. The amounts of betaine surfactant present in the composition is preferably from about 1% to about 20% and more preferably from about 5% to about 10%, by weight of the surfactant system.

If desired, other conventional nonionic surfactants such as the $C_{12}$–$C_{18}$alkyl ethoxylates ("ALE") including the so-called narrow peaked alkyl ethoxylates and $C_6$–$C_{12}$alkyl phenol alkoxylates (especially ethoxylates and mixed ethoxy/propoxy), and the like, can also be included in the overall compositions at levels of from about 5% to about 40% by weight of the surfactant system.

DETERGENCY BUILDERS

The handwashing detergent composition also includes a detergent builder to assist in controlling mineral hardness and to enhance the removal of particulate soils. Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locations. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein.

Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crisping agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/FDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehi, issued Mar. 7, 1967. See also Diehi U.S. Pat. No. 3,723,322.

Fatty acids, e.g., $C_{12}$–$C_{18}$monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

ADJUNCT INGREDIENTS

The compositions herein can optionally include one or more other detergent adjunct materials or other materials for assisting or enhancing cleaning performance, treatment of the substrate to be cleaned, or to modify the aesthetics of the detergent composition (e.g., perfumes, colorants, dyes, etc.). The following are illustrative examples of such adjunct materials.

Enzymes—Enzymes can be included in the formulations herein for a wide variety of fabric laundering purposes, including removal of protein-based, carbohydrate-based, or triglyceride-based stains, for example, and for the prevention of refugee dye transfer, and for fabric restoration. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin.

However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 50 mg by weight, more typically about 0.01 mg to about 30 mg, of active enzyme per gram of the composition. Stated otherwise, the compositions herein will typically comprise from about 0.001% to about 5%, preferably 0.01%–1% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the trade names ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985); Protease B (see European Patent Application Serial No. 87303761.8, filed Apr. 28, 1987, and European Patent Application 130,756, Bott et al, published Jan. 9, 1985); and proteases made by Genencor International, Inc., according to one or more of the following patents: Caldwell et al, U.S. Pat. Nos. 5,185,285, 5,204,015 and 5,244,791.

Amylases include, for example, α-amylases described in British Patent Specification No. 1,296,839 (Novo), RAPIDASE, International Bio-Synthetics, Inc. and TERMAMYL, Novo Industries.

The cellulase usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from *Humicola insolens* and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS-2.247.832. CAREZYME (Novo) is especially useful.

Suitable lipase enzymes for detergent usage include those produced by microorganisms of the Pseudomonas group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum*, e.g. *Chromobacter viscosum* var. lipolyticum NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases ex *Pseudomonas gladioli*. The LIPOLASE enzyme derived from *Humicola lanuginosa* and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Petoxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued July 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Enzyme Stabilizers—The enzymes employed herein are stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used.) Additional stability can be provided by the presence of various other art-disclosed stabilizers, especially borate species: see Severson, U.S. Pat. No. 4,537,706. Typical detergents, especially liquids, will comprise from about 1 to about 30, preferably from about 2 to about 20, more preferably from about 5 to about 15, and most preferably from about 8 to about 12, millimoles of calcium ion per liter of finished composition. This can vary somewhat, depending on the amount of enzyme present and its response to the calcium or magnesium ions. The level of calcium or magnesium ions should be selected so that there is always some minimum level available for the enzyme, after allowing for complexation with builders, fatty acids, etc., in the composition. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. A small amount of calcium ion, generally from about 0.05 to about 0.4 millimoles per liter, is often also present in the composition due to calcium in the enzyme slurry and formula water. In solid detergent compositions the formulation may include a sufficient quantity of a water-soluble calcium ion source to provide such amounts in the laundry liquor. In the alternative, natural water hardness may suffice.

It is to be understood that the foregoing levels of calcium and/or magnesium ions are sufficient to provide enzyme stability. More calcium and/or magnesium ions can be added to the compositions to provide an additional measure of grease removal performance. Accordingly, as a general proposition the compositions herein will typically comprise from about 0.05% to about 2% by weight of a water-soluble source of calcium or magnesium ions, or both. The amount can vary, of course, with the amount and type of enzyme employed in the composition.

The compositions herein may also optionally, but preferably, contain various additional stabilizers, especially borate-type stabilizers. Typically, such stabilizers will be used at levels in the compositions from about 0.25% to about 10%, preferably from about 0.5% to about 5%, more preferably from about 0.75% to about 3%, by weight of boric acid or other borate compound capable of forming boric acid in the composition (calculated on the basis of boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

Bleaching Compounds—Bleaching Agents and Bleach Activators—The detergent compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetra-hydrate) can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application Ser. No. 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble suffactants. Percarbonate is available from various commercial sources such as FMC, Solvay and Tokai Denka.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L$$

or $$R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamidocaproyl)oxybenzenesulfonate, (6-nonanamidocaproyl)oxybenzenesulfonate, (6-decanamidocaproyl)oxybenzenesulfonate, and mixtures thereof as described in U.S. Pat. No. 4,634,551, incorporated herein by reference.

Another class of bleach activators comprises the benzoxazine-type activators disclosed by Hodge et al in U.S. Pat. No. 4,966,723, issued Oct. 30, 1990, incorporated herein by reference. A highly preferred activator of the benzoxazine-type is:

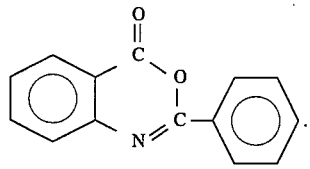

Still another class of preferred bleach activators includes the acyl and diacyl lactam activators, especially acyl caprolactams and acyl valerolactams of the formulae:

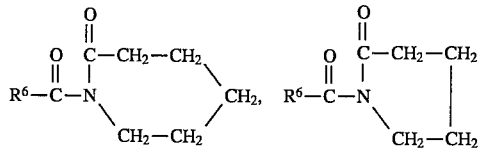

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam, terephthaloyl caprolactum and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. Nos. 5,246,621, 5,244,594; 5,194,416; 5,114,606; and European Pat. App. Pub. Nos. 549,271A1, 549,272A1, 544,440A2, and 544,490A1; Preferred examples of these catalysts include $Mn^{IV}{}_2$(u—O)$_3$(1,4,7-trimethyl-1,4,7-triazacyclononane)$_2$(PF$_6$)$_2$, $Mn^{III}{}_2$(u—O)$_1$(u—OAc)$_{2-}$(1,4,7-trimethyl-1,4,7-triazacyclononane)$_2$(ClO$_4$)$_2$, $Mn^{IV}{}_4$(u—O)$_6$(1,4,7-triazacyclononane)$_4$(ClO$_4$)$_4$, $Mn^{III}Mn^{IV}{}_4$(u—O)$_1$(u—OAc)$_{2-}$ (1,4,7-trimethyl-1,4,7-triazacyclononane)$_4$(ClO$_4$)$_4$, $MN^{III}Mn^{IV}{}_4$(u—O)$_1$(u—OAc)$_{2-}$ (1,4,7-trimethyl-1,4,7-triazacyclononane)—(OCH$_3$)$_3$(PF6), and mixtures thereof. Other metal-based bleach catalysts include those disclosed in U.S. Pat. Nos. 4,430,243 and 5,114,611. The use of manganese with various complex ligands to enhance bleaching is also reported in the following U.S. patent numbers: U.S. Pat. Nos. 4,728,455; 5,284,944; 5,246,612; 5,256,779; 5,280,117; 5,274,147; 5,153,161; 5,227,084.

As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about I ppm to about 500 ppm, of the catalyst species in the laundry liquor.

Polymeric Soil Release Agent—Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$oxyalkylene terephthalate segments, wherein, if said hydrophobe components also comprise oxyethylene terephthalate, the ratio of oxyethylene terephthalate: $C_3$oxyalkylene terephthalate units is about 2:1 or lower, (ii) $C_4$–$C_6$alkylene or oxy $C_4$–$C_6$alkylene segments, or mixtures therein, (iii) poly (vinyl ester) segments, preferably polyvinyl acetate), having a degree of polymerization of at least 2, or (iv) $C_1$–$C_4$alkyl ether or $C_4$hydroxyalkyl ether substituents, or mixtures therein, wherein said substituents are present in the form of $C_1$–$C_4$alkyl ether or $C_4$hydroxyalkyl ether cellulose derivatives, or mixtures therein, and such cellulose derivatives are amphiphilic, whereby they have a sufficient level of $C_1$–$C_4$alkyl ether and/or $C_4$hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from about 200, although higher levels can be used, preferably from 3 to about 150, more preferably from 6 to about 100. Suitable oxy $C_4$–$C_6$alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselinde.

Polymeric soil release agents useful in the present invention also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$alkyl and $C_4$ hydroxyalkyl cellulose; see U.S. Pat. No. 4,000,093, issued Dec. 28, 1976 to Nicol, et al.

Soil release agents characterized by poly(vinyl ester) hydrophobe segments include graft copolymers of poly(vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN type of material, e.g., SOKALAN HP-22, available from BASF (West Germany).

One type of preferred soil release agent is a copolymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another preferred polymeric soil release agent is a polyester with repeat units of ethylene terephthalate units contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5 126 (from DuPont) and MILEASE T (from ICI). See also U.S. Pat. No. 4,702,857, issued Oct. 27, 1987 to Gosselittle.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic endcapped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoarolyl, end-capped terephthalate esters.

If utilized, soil release agents will generally comprise from about 0.01% to about 10.0%, by weight, of the detergent compositions herein, typically from about 0.1% to about 5%, preferably from about 0.2% to about 3.0%.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate endcaps. A particularly preferred soil release agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. Said soil release agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof.

Chelating Agents—The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylenediamine triacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

If utilized, these chelating agents will generally comprise from about 0.1% to about 10% by weight of the detergent compositions herein. More preferably, if utilized, the chelating agents will comprise from about 0.1% to about 3.0% by weight of such compositions.

Clay Soil Removal/Anti-redeposition Agents—The compositions of the present invention can also optionally contain water-soluble ethoxylated amines having clay soil removal and antiredeposition properties. Granular detergent compositions which contain these compounds typically contain from about 0.01% to about 10.0% by weight of the water-soluble ethoxylates amines; liquid detergent compositions typically contain about 0.01% to about 5%.

The most preferred soil release and anti-redeposition agent is ethoxylated tetraethylene-pentamine. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. Another type of preferred antiredeposition agent includes the carboxy methyl cellulose (CMC) materials. These materials are well known in the art.

Polymeric Dispersing Agents—Polymeric dispersing agents can advantageously be utilized at levels from about 0.1% to about 7%, by weight, in the compositions herein, especially in the presence of zeolite and/or layered silicate builders. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release peptization, and anti-redeposition.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic arthydride), fumaric acid, itaconic acid, aconitic acid, mesaconic acid, citraconic acid and methylene malonic acid. The presence in the polymeric polycarboxylates herein or monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehi, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published September 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Brightener—Any optical brighteners or other brightening or whitening agents known in the art can be incorporated at levels typically from about 0.05% to about 1.2%, by weight, into the detergent compositions herein. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Artic White CC and Artic White CWD, available from Hilton-Davis, located in Italy; the 2-(4-stryl-phenyl)-2H-napthol[1,2-d]triazoles; 4,4'-bis-(1,2,3-triazol-2-yl)-stil-benes; and the aminocoumarins. Specific examples of these brighteners include 4-methyl-7-diethyl amino coumarin; 1,2-bis(-venzimidazol-2-yl)ethylene; 1,3-diphenyl-phrazolines; 2,5-bis(benzoxazol-2-yl)thiophene; 2-stryl-napth-[1,2-d]oxazole; and 2-(stilbene-4-yl)-2H-naphtho-[1,2-d]triazole. See also U.S. Pat. No. 3,646,015, issued Feb. 29, 1972 to Hamilton. Anionic brighteners are preferred herein.

Dye Transfer Inhibiting Agents—The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: $R—A_x—P$; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N=; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

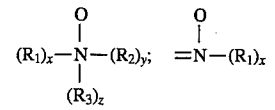

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the detergent compositions herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis,* Vol 113. "Modern Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3: 1, most preferably from 0.6:1 to 0.4:1. These copolymers can be either linear or branched.

The present invention compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1. to about 10:1.

The detergent compositions herein may also optionally contain from about 0.005% to 5% by weight of certain types of hydrophilic optical brighteners which also provide a dye transfer inhibition action. If used, the compositions herein will preferably comprise from about 0.01% to 1% by weight of such optical brighteners.

The hydrophilic optical brighteners useful in the present invention are those having the structural formula:

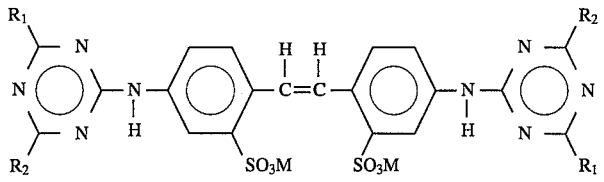

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6—(N-2-bis-hydroxyethyl)-s-triazine-2 -yl)amino]-2,2'-stilbenedisulfonic acid and disodium salt. This particular brightener species is commercially marketed under the trade name Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6—(N-2-hydroxyethyl-N-methylamino)-s-triazine-2-yl)amino] 2,2'-stilbenedisulfonic acid disodium salt. This particular brightener species is commercially marketed under the trade name Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2-stilbenedisulfonic acid, sodium salt. This particular brightener species is commercially marketed under the trade name Tinopal AMS-GX by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous wash solutions than does either of these two detergent composition components when used alone. Without being bound by theory, it is believed that such brighteners work this way because they have high affinity for fabrics in the wash solution and therefore deposit relatively quick on these fabrics. The extent to which brighteners deposit on fabrics in the wash solution can be defined by a parameter called the "exhaustion coefficient". The exhaustion coefficient is in general as the ratio of a) the brightener material deposited on fabric to b) the initial brightener concentration in the wash liquor. Brighteners with relatively high exhaustion coefficients are the most suitable for inhibiting dye transfer in the context of the present invention.

Of course, it will be appreciated that other, conventional optical brightener types of compounds can optionally be used in the present compositions to provide conventional fabric "brightness" benefits, rather than a true dye transfer inhibiting effect. Such usage is conventional and well-known to detergent formulations.

Other Ingredients—A wide variety of other ingredients useful in detergent compositions can be included in the compositions herein, including other active ingredients, carriers, hydrotropes, processing aids, dyes or pigments, solvents for liquid formulations, solid fillers for bar compositions, etc. If desired, soluble magnesium salts such as $MgCl_2$, $MgSO_4$, and the like, can be added at levels of, typically, 0.1%–2%, to provide additional suds and to enhance grease removal performance.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, DeGussa) is admixed with a proteolytic enzyme solution containing 3%–5% of $C_{13-15}$ ethoxylated alcohol (EO 7) nonionic surfactant. Typically, the enzyme/surfactant solution is 2.5 X the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned enzynes, bleaches, bleach activators, bleach catalysts, photo activators, dyes, fluorescers, fabric conditioners and hydrolyzable surfactants can be "protected" for use in detergents, including liquid laundry detergent compositions.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used. The compositions may contain from 5% to 90%, typically 10% to 50% of such carriers.

The detergent compositions herein will preferably be formulated such that, during use in aqueous cleaning operations, the wash water will have a pH of between about 6.5 and about 11, preferably between about 7 and 10. Techniques for controlling pH at recommended usage levels include the use of buffers, alkalis, acids, etc., and are well known to those skilled in the art.

In order to make the present invention more readily understood, reference is made to the following examples, which are intended to be illustrative only and not intended to be limiting in scope.

EXAMPLE 1

Several handwash laundry bars according to the invention which are made via standard extrusion processes are set forth in Table I below.

TABLE I

| Component | (% weight) A | B | C | D |
|---|---|---|---|---|
| $C_{16-18}$ N-methyl glucose amide | 2.3 | 2.3 | 2.3 | 2.3 |
| $C_{12-14}$ dimethyl amine oxide | 1.9 | 1.9 | 1.9 | 1.9 |
| $C_{12-15}$ alkyl ethoxylate (EO = 5) | 7.3 | 7.3 | 6.0 | 4.7 |
| $C_{14-15}$ alkyl ethoxy (EO = 1) sulfate | 14.0 | 14.0 | 14.0 | 14.0 |
| Coco amidopropyl betaine | — | — | 1.3 | 2.6 |
| Sodium tripolyphosphate | 25.0 | 15.0 | 10.0 | 7.0 |
| Sodium polyacrylate (MW = 4500) | 3.0 | 15.0 | 15.0 | 3.0 |
| Diethyltriaminepentamethyl phosphonate | 1.6 | 15.0 | 15.0 | 1.6 |

TABLE I-continued

| Component | (% weight) A | B | C | D |
|---|---|---|---|---|
| Carboxymethyl cellulose | 0.4 | 0.4 | 0.4 | 0.4 |
| Protease enzyme | 1.0 | 1.0 | 1.0 | 1.0 |
| Cellulase enzyme | 0.15 | 0.15 | 0.15 | 0.15 |
| Lipase enzyme | 0.12 | — | — | 0.12 |
| Amylase enzyme | 0.4 | 0.15 | 0.15 | 0.4 |
| Sodium silicate | 7.0 | 7.0 | 7.0 | 7.0 |
| Polymeric soil release agent | 0.3 | 0.3 | 0.3 | 0.3 |
| Sodium perborate | — | 2.0 | 2.0 | — |
| Nonanoyloxybenzenesulfonate (NOBS) | — | 3.2 | 3.2 | — |
| Brightener 15[1] | 0.15 | 0.15 | 0.15 | 0.15 |
| Brightener 49[1] | 0.05 | 0.05 | 0.05 | 0.05 |
| Misc. (sulfate, water, perfume, etc.) | 35.33 | 15.1 | 20.1 | 53.33 |
| TOTAL | 100.00 | 100.0 | 100.0 | 100.00 |

[1]Commercially available from Ciba-Geigy Corporation.

EXAMPLE II

Several handwash laundry detergent compositions in granular form according to the invention which are made via standard spray-drying or agglomeration processes are set forth in Table II below

TABLE II

| Component | (% weight) E | F | G | H |
|---|---|---|---|---|
| $C_{16-18}$ N-methyl glucose amide | 2.3 | 2.3 | 2.3 | 2.3 |
| $C_{12-14}$ dimethyl amine oxide | 1.9 | 1.9 | 1.9 | 1.9 |
| $C_{12-15}$ alkyl ethoxylate (EO = 5) | 7.3 | 7.3 | 6.0 | 4.7 |
| $C_{14-15}$ alkyl ethoxy (EO = 1) sulfate | 14.0 | 14.0 | 14.0 | 14.0 |
| Coco amidopropyl betaine | — | — | 1.3 | 2.6 |
| Sodium tripolyphosphate | 25.0 | 15.0 | 10.0 | 7.0 |
| Sodium polyacrylate (MW = 4500) | 3.0 | 15.0 | 15.0 | 3.0 |
| Diethyltriaminepentamethyl phosphonate | 1.6 | 15.0 | 15.0 | 1.6 |
| Carboxymethyl cellulose | 0.4 | 0.4 | 0.4 | 0.4 |
| Protease enzyme | 1.0 | 1.0 | 1.0 | 1.0 |
| Cellulase enzyme | 0.15 | 0.15 | 0.15 | 0.15 |
| Lipase enzyme | 0.12 | — | — | 0.12 |
| Amylase enzyme | 0.4 | 0.15 | 0.15 | 0.4 |
| Sodium silicate | 7.0 | 7.0 | 7.0 | 7.0 |
| Polymeric soil release agent | 0.3 | 0.3 | 0.3 | 0.3 |
| Sodium perborate | — | 2.0 | 2.0 | — |
| Nonanoyloxybenzenesulfonate (NOBS) | — | 3.2 | 3.2 | — |
| Brightener 15[1] | 0.15 | 0.15 | 0.15 | 0.15 |
| Brightener 49[1] | 0.05 | 0.05 | 0.05 | 0.05 |
| Misc. (sulfate, water, perfume, etc.) | 35.33 | 15.1 | 20.1 | 53.33 |
| TOTAL | 100.00 | 100.0 | 100.0 | 100.00 |

[1]Commercially available from Ciba-Geigy Corporation.

EXAMPLE III

A handwash laundry detergent composition in liquid form is set forth below in Table III:

TABLE III

| Component | (% weight) I |
|---|---|
| $C_{16-18}$ N-methyl glucose amide | 2.3 |
| $C_{12-14}$ dimethyl amine oxide | 1.9 |
| $C_{12-15}$ alkyl ethoxylate (EO = 5) | 4.7 |
| $C_{14-15}$ alkyl ethoxy (EO = 1) sulfate | 14.0 |
| Coco amidopropyl betaine | 2.6 |
| Sodium tripolyphosphate | 7.0 |
| Sodium polyacrylate (MW = 4500) | 3.0 |
| Diethyltriaminepentamethyl phosphonate | 1.6 |
| Protease enzyme | 1.0 |
| Cellulose enzyme | 0.15 |
| Lipase enzyme | 0.12 |
| Amylase enzyme | 0.4 |
| Polymeric soil release agent | 0.3 |
| Misc. (water, solvent, brighteners, perfume, etc.) | 60.93 |
| TOTAL | 100.00 |

[1]Commercially available from Ciba-Geigy Corporation.

Having thus described the invention in detail, it will be clear to those skilled in the art that various changes may be made without departing from the scope of the invention and the invention is not to be considered limited to what is described in the specification.

What is claimed is:

1. A laundry detergent composition for use in handwash operations comprising:

(a) from about 5% to about 50% by weight of a surfactant system including, by weight of said surfactant system, (i) from about 50% to about 75% of $C_{14}$–$C_{15}$alkyl ethoxy sulfate surfactant having an average degree of etholation of one (ii) from about 10% to about 40% of a nonionic surfactant mixture containing a polyhydroxy fatty acid amide surfactant and a $C_{12-14}$ dimethyl amine oxide surfactant, wherein the weight ratio of said polyhydroxy fatty acid amide to said amine oxide is from about 1:5 to about 5:1;

(iii) from about 5% to about 10% of cocoamidopropyl betaine surfactant; and (iv) from about 5% to about 40% of a $C_{12}$–$C_{15}$alkyl ethoxylate having an average degree of ethoxylation of five:

wherein said composition does not contain alkylbenzene sulfonates;

(b) from about 1% to about 50% of a detergency builder;

(c) from about 1% to about 7% of a sodium polyacrylate; and (d) the balance comprising adjunct detergent ingredients.

2. The laundry detergent composition of claim 1 wherein said adjunct detergent ingredients are selected from the group consisting of bleaching agents, bleach activators, enzymes, polymeric anti-redeposition agents, polymeric dispersants, polymeric soil release agents, chelants, perfumes, dye transfer inhibitors and mixtures thereof.

3. The laundry detergent composition of claim 1 wherein said composition is in liquid form.

4. The laundry detergent composition of claim 1 wherein said composition is in granular form.

5. The laundry detergent composition of claim 1 wherein said composition is in the form of a laundry bar.

6. A method of laundering soiled clothes comprising the step of contacting said clothes by way of a users hands with an effective amount of a laundry detergent composition according to claim 1 in an aqueous solution.

* * * * *

UNITED STATES PATENT AND TRADEMARK OFFICE

CERTIFICATE OF CORRECTION

PATENT NO. : 5,500,153

DATED : March 19, 1996

INVENTOR(S) : Francisco R. Figueroa et al.

It is certified that error appears in the above-indentified patent and that said Letters Patent is hereby corrected as shown below:

Column 5, line 44, change "shortchain" to --short chain--.

Column 5, line 59, change "2hydroxyethylamine" to --2-hydroxyethylamine--.

Column 6, line 27, change "("ALE")" to -- ("AE")--.

Column 7, line 66, change "1,3,5-trihydroxy" to --1, 3, 5-trihydroxy--.

Column 7, line 67, change "2,4,6-trisulphonic" to --2, 4, 6-trisulphonic--.

Column 8, line 58, change "Enzymes—" to --Enzymes - --.

Column 10, line 12, change "Petoxidase" to --Peroxidase--.

Column 10, line 34, change "Enzyme Stabilizers—" to --Enzyme Stabilizers - --.

Column 11, line 24, change "Bleaching Compounds—" to --Bleaching Compounds - --.

Column 11, line 49, change "patent application" to --Patent Application--.

Column 12, line 2, change "suffactants" to --surfactants--.

Column 12, line 35, change "(6-octanamidocaproyl) to --(6-octanamido caproyl)--.

Column 12, line 36, change "(6-nonanamidocaproyl) to --(6-nonanamido caproyl)--.

Column 13, line 36, change "U.S. patent numbers:" to --United States Patents:--.

Column 13, line 44, change "I ppm" to --1 ppm--.

UNITED STATES PATENT AND TRADEMARK OFFICE

CERTIFICATE OF CORRECTION

PATENT NO. : 5,500,153

DATED : March 19, 1996

INVENTOR(S) : Francisco R. Figueroa et al.

It is certified that error appears in the above-indentified patent and that said Letters Patent is hereby corrected as shown below:

Column 13, line 46, change "Polymeric Soil Release Agent—" to --Polymeric Soil Release Agent - --.

Column 14, line 40, change "Gosselinde" to --Gosselink--.

Column 15, line 8, change "5 126" to --5126--.

Column 15, line 10, change "Gosselittle" to --Gosselink--.

Column 15, line 21, change "endcapped" to --end capped--.

Column 15, line 38, change "endcaps" to --end caps--.

Column 15, line 49, change "Chelating Agents—" to --Chelating Agents - --.

Column 16, line 22, change "Clay Soil Removal/Anti-redeposition Agents—" to --Clay Soil Removal/Anti-redeposition Agents - --.

Column 16, line 31, change "tetraethylene pentamine" to --tetraethylenepentamine--.

Column 16, line 49, change "Polymeric Dispersing Agents—" to --Polymeric Dispersing Agents - --.

Column 16, line 67, change "arthydride" to --anhydride--.

Column 17, line 54, change "Brightener—" to --Brightener - --.

Column 18, lines 9-10, change "4,4'-bis-(1,2,3-triazol-2-yl)-stil-benes;" to --4,4'bis(stryl)bisphenyls;--.

Column 18, line 17, change "Dye Transfer Inhibiting Agents—" to --Dye Transfer Inhibiting Agents - --.

Column 19, line 38, change "3:1." to --3:1--.

UNITED STATES PATENT AND TRADEMARK OFFICE

CERTIFICATE OF CORRECTION

PATENT NO. : 5,500,153

DATED : March 19, 1996

INVENTOR(S) : Francisco R. Figueroa et al.

It is certified that error appears in the above-indentified patent and that said Letters Patent is hereby corrected as shown below:

Column 20, line 58, change "Other Ingredients—" to --Other Ingredients - --.

Column 21, line 20, change "enzynes" to --enzymes--.

Column 21, line 47, change "EXAMPLE 1" to --EXAMPLE I--.

Column 23, line 34, change "etholation of one" to --ethoxylation of one;--.

Column 24, line 11, change "five:" to --five;--.

Column 24, lines 20-21, take out "polymeric dispersants".

Signed and Sealed this

Seventeenth Day of September, 1996

*Attest:*

Bruce Lehman

BRUCE LEHMAN

*Attesting Officer*

*Commissioner of Patents and Trademarks*